US006712018B2

(12) United States Patent
Cassell et al.

(10) Patent No.: US 6,712,018 B2
(45) Date of Patent: Mar. 30, 2004

(54) SHIELDING FAIRING FOR A PERSONAL WATERCRAFT

(75) Inventors: Shannon Cassell, Palm Bay, FL (US); Daniel Nadeau, St-Denis-de-Brompton (CA); Pascal Vincent, Valcourt (CA)

(73) Assignee: Bombardier Recreational Products Inc., Saint-Bruno (CA)

( * ) Notice: Subject to any disclaimer, the term of this patent is extended or adjusted under 35 U.S.C. 154(b) by 0 days.

(21) Appl. No.: 10/217,325

(22) Filed: Aug. 13, 2002

(65) Prior Publication Data

US 2003/0047125 A1 Mar. 13, 2003

Related U.S. Application Data

(60) Provisional application No. 60/318,627, filed on Sep. 13, 2001.

(51) Int. Cl.[7] ..... B63B 17/00
(52) U.S. Cl. ..... 114/364
(58) Field of Search ..... 114/343, 361, 114/362, 363, 364

(56) References Cited

U.S. PATENT DOCUMENTS 5,372,082 A * 12/1994 Hattori ..... 114/144 R
5,447,116 A * 9/1995 Kobayashi ..... 114/363
5,490,474 A * 2/1996 Ikeda ..... 114/343
5,537,948 A * 7/1996 Kobayashi ..... 114/362
5,697,318 A * 12/1997 Kobayashi ..... 114/343
5,850,803 A * 12/1998 Jones et al. ..... 114/343
5,943,979 A * 8/1999 Hattori ..... 114/362
5,964,172 A * 10/1999 Ikeda ..... 114/363
6,041,732 A * 3/2000 Ikeda ..... 114/363
6,116,182 A * 9/2000 Koyanagi ..... 114/362
6,158,378 A * 12/2000 Tsumiyama et al. ..... 114/363

* cited by examiner

*Primary Examiner*—S. Joseph Morano
*Assistant Examiner*—Lars A. Olson
(74) *Attorney, Agent, or Firm*—BRP Legal Services

(57) ABSTRACT

A watercraft, equipped with a shielding fairing, is disclosed. The configuration and arrangement of the shielding fairing provides a shielded area rearward of the shielding fairing to shield an operator and passengers of the watercraft from water spray during operation of the watercraft. The shielding fairing is disposed on the deck of the watercraft, preferably between the gunwale and a portion of the deck adjacent to a hood at the front of the watercraft.

29 Claims, 7 Drawing Sheets

SHIELDING FAIRING FOR A PERSONAL WATERCRAFT

This application relies for priority on U.S. Provisional Patent Application Ser. No. 60/318,627, filed on Sep. 13, 2001, entitled "SHIELDING FAIRING FOR A PERSONAL WATERCRAFT." The contents of the provisional application are incorporated herein by reference.

FIELD OF THE INVENTION

This invention relates to watercraft and, in particular, to a shielding fairing for a personal watercraft.

Description of the Related Art

Personal watercraft are designed for high speeds and responsive handling. During operation, the operator and passenger(s) are exposed to various environmental elements, including wind and water.

In the typical arrangement for a conventional personal watercraft, when seated, the operator and passengers straddle the seat on the vessel. In the typical straddle position, the legs of the operator and the passenger(s) extend downwardly on either side of the seat. As a result, during operation, the legs of the operator and the passenger(s) may be sprayed with water.

While the operator and passenger(s) expect to be sprayed with water, a desire has developed for a design for a personal watercraft where water spray is directed away from the operator and the passenger(s), at least to a limited extent. In other words, a desire has arisen for a personal watercraft that provides an increased level of comfort by lessening the amount of air and water spray on the operator and passenger(s).

Such a feature has not been proffered by the prior art.

SUMMARY OF THE INVENTION

It is, therefore, an aspect of the present invention to provide a watercraft with a design that improves upon the comfort afforded to an operator and passenger(s) riding on the personal watercraft.

More particularly, it is an aspect of the present invention to provide a design for a personal watercraft where water spray is directed away from the operator and passenger(s).

One embodiment of the present invention provides a watercraft including a hull, an engine mounted within the hull, a deck mounted on the hull, a seat mounted on the deck, and a shielding fairing on the deck, extending outwardly from the deck at a position forward of the seat. The fairing defines a shielded area rearward thereof.

Other embodiments of the present invention will become apparent from the description that follows.

BRIEF DESCRIPTION OF THE DRAWINGS

The accompanying drawings, which are incorporated in and constitute a part of the specification, illustrate embodiments of the invention and, together with the general description given above and the detailed description of the embodiments given below, serve to explain the principles of the present invention. In the figures.

DETAILED DESCRIPTION OF THE PREFERRED EMBODIMENTS

Figure 1:
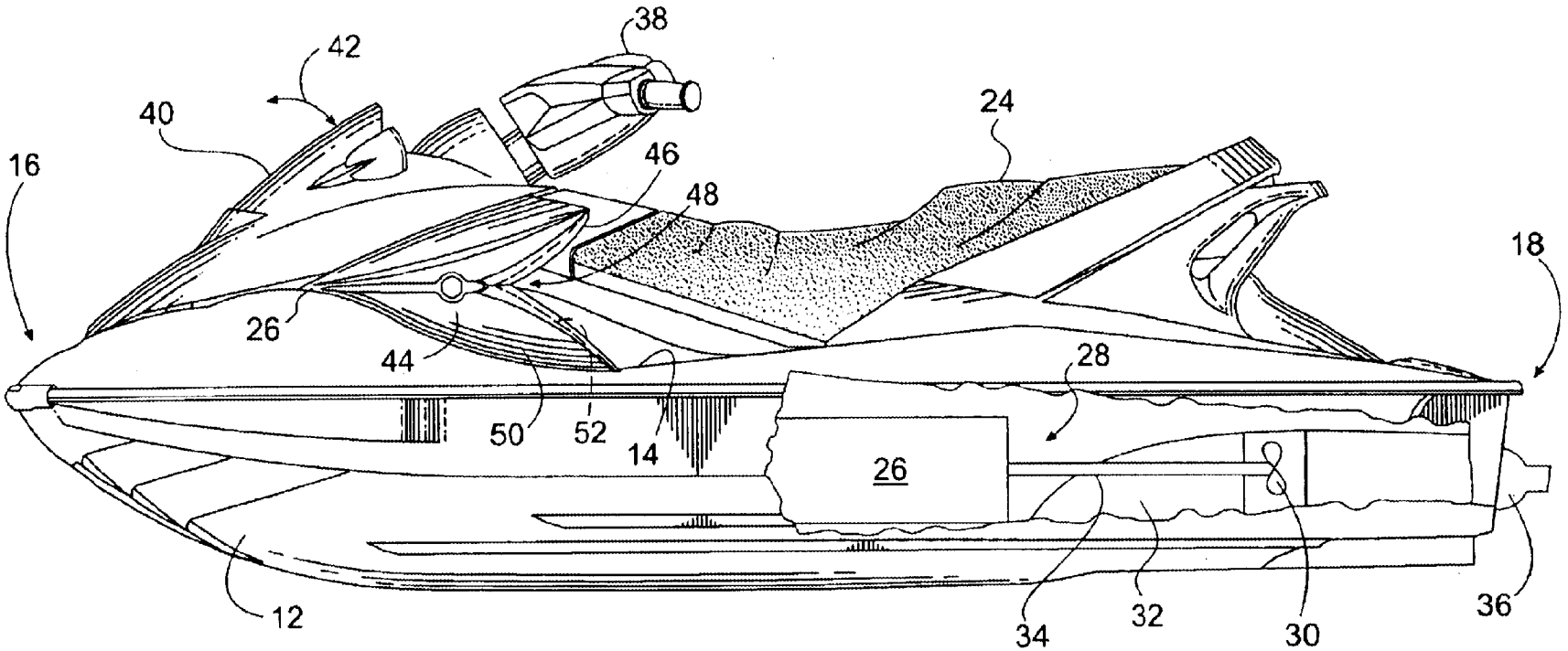
FIG. 1 is a left side view of the watercraft of the present invention, displaying the location of the shielding fairing according to one embodiment.
Figure 2:
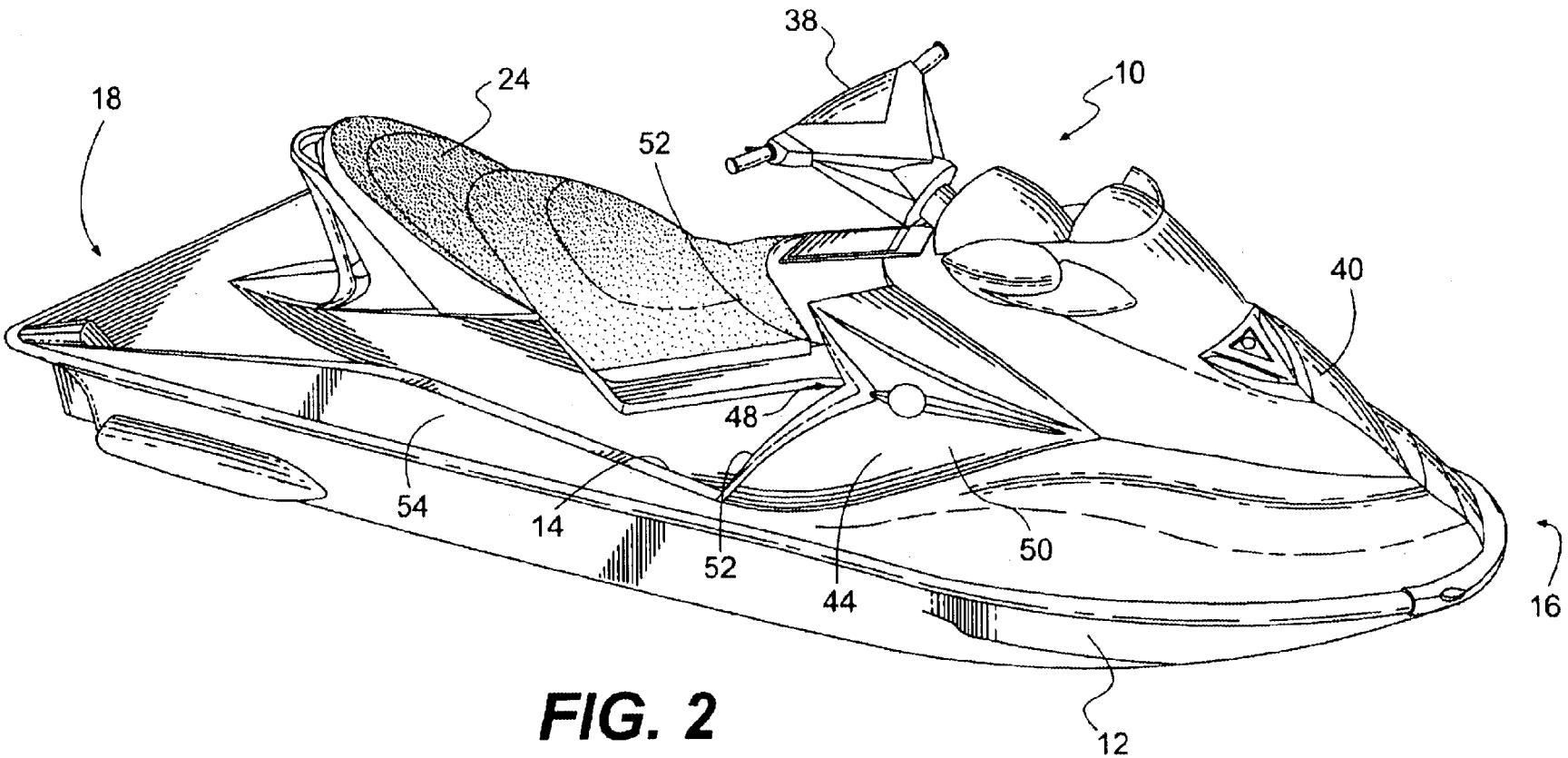
FIG. 2 is a perspective view of the watercraft depicted in FIG. 1, the view being taken from the right, front side of the watercraft.

FIG. 1 is a perspective view of one embodiment of the watercraft 10 of the present invention. Before delving into the details of the construction of the watercraft 10, it is noted that the terms "forward," "rearward," "port," "starboard," "bow," "stern," "left," and "right" are defined according to the normal travel direction of the watercraft 10.

In the preferred embodiment, the watercraft 10 includes a hull 12, which refers to the bottom portion of the body of the watercraft 10. A deck 14 is disposed on the hull 12 to complete the body of the watercraft 10. In the embodiment illustrated, the deck 14 is affixed to the hull 12 via an adhesive to prevent water from seeping into the interior of the watercraft 10 during operation. As would be appreciated by those skilled in the art, however, the deck 14 need not be glued to the hull 12. To the contrary, the two portions of the body of the watercraft 10 may be removably connected to one another by suitable fasteners.

According to nautical custom, the front end of the watercraft is referred to as the bow 16. The rear end is referred to as the stern 18. The left side of the watercraft 10 is referred to as the port side 20. Finally, the right side of the watercraft 10 is referred to as the starboard side 22.

The deck 14 of the watercraft 10 includes a seat 24. The seat 24 shown throughout the figures is commonly referred to as a "straddle seat" or as a "straddle-type seat," because the operator and passenger(s) of the watercraft 10 straddle the seat when seated thereon. In other words, the operator and passenger(s) position themselves on the seat 24 so that their legs are disposed on the port 20 and starboard 22 sides of the seat 24.

While the embodiment shown specifically depicts a straddle seat 24, the present invention contemplates that the watercraft 10 alternatively could include a bucket seat or a pair of bucket seats disposed on the deck 14. In still further alternative constructions, the watercraft 10 could be constructed with a bucket seat for the operator and a straddle seat for the passengers, or vice versa. In other words, a particular seating configuration is not required to practice the present invention.

In the embodiment illustrated, the watercraft 10 is powered by an engine 26, which is disposed within the body of the watercraft 10 between the hull 12 and the deck 14. FIG. 1 provides a simplified schematic illustration of the engine 26 and the remainder of the propulsion system 28, of which the engine 26 is a part. In the embodiment shown, the propulsion system 28 is a jet propulsion system and the engine 26 is an internal combustion engine. The propulsion system 28 includes an impeller 30 disposed within a water tunnel 32 that extends from a position at the bottom of the hull 12 to the stern 18 of the watercraft 10. The impeller 30 is connected to the engine 26 via an impeller shaft 34.

During operation of the watercraft 10, the engine drives the impeller shaft 34 and, accordingly, the impeller 30. As the impeller 30 rotates, water is drawn into the water tunnel 32 from the bottom of the watercraft 10. The impeller 30 discharges the water through a nozzle 36 at the rear of the watercraft 10. Since the water is discharged at high speed, the discharged water propels the watercraft 10.

As illustrated in FIG. 1, the watercraft 10 includes a steering handlebar 38, which is disposed forward of the seat 24. The handlebar 38 is operatively connected to the nozzle 36 to control the direction of the nozzle 36. By controlling the direction of the nozzle 36, the operator controls the direction of the water discharged from the stern 18 of the watercraft 10. Accordingly, controlling the direction of the nozzle 36 controls the direction of the watercraft 10.

It should be noted that the present invention is not limited solely to a watercraft 10 with an internal combustion engine 26 connected to a jet propulsion system 28. To the contrary, it is contemplated that the engine 26 could be replaced with an electric motor powered by batteries or a fuel cell, for example. In addition, the propulsion system 28 could comprise a propeller driven by an inboard or an outboard engine.

The watercraft 10 includes a hood 40 disposed on an upper portion of the deck 14. The hood 40 is pivotally connected to the deck 14 at a forward portion of the deck 14 so that the hood 40 opens in the direction of the arrow 42. A storage compartment (not shown) is disposed beneath the hood 40 for stowage of items therein.

Shielding fairings 44 are positioned, one on each of the port and the starboard sides 20, 22 of the watercraft 10. As illustrated, the shielding fairings 44 extend upwardly from the port and starboard gunwales 54 to positions adjacent to the hood 40. The shielding fairings 44 are essentially V-shaped, with the vertices of the V's pointing toward the bow 16 of the watercraft 10. The rear ends 46 of the shielding fairings 44 include indented portions 48. The port and starboard shielding fairings 44 are mirror images of one another. Together, the shielding fairings 44 and the hood 40 form a contiguous exterior appearance for the watercraft 10 when the hood 40 is in the closed position.

As discussed above, in the embodiment illustrated, the shielding fairings 44 do not connect to the hood 40. This permits the hood 40 to be opened easily. It is contemplated, however, that the shielding fairings 44 alternatively may be connected to the hood 40. If so connected, the shielding fairings 44 would be lifted together with the hood 40 when the hood 40 is opened.

Figure 4:
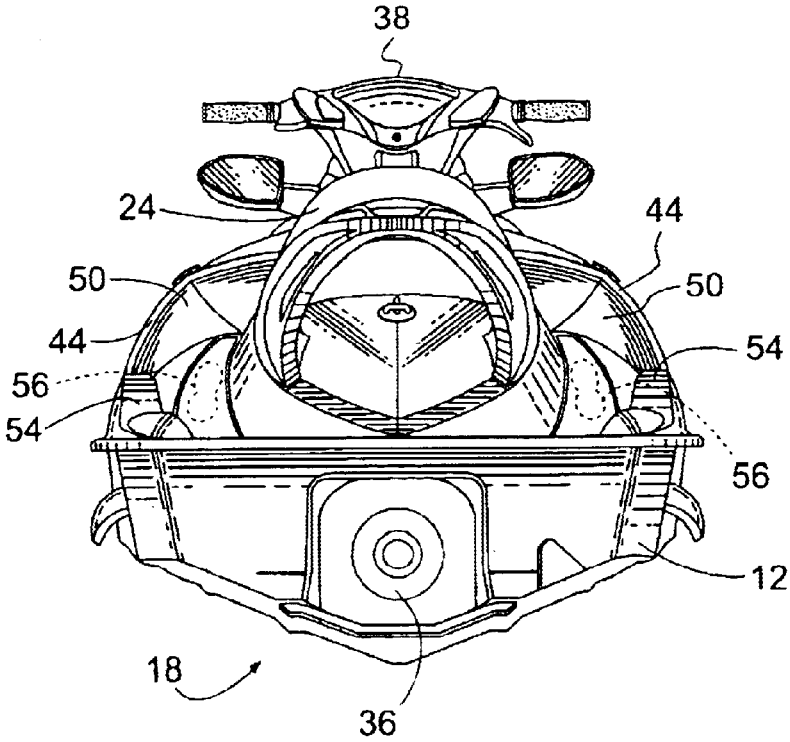
FIG. 4 is a rear view of the watercraft illustrated in FIG. 1.

As best illustrated in FIG. 4, the shielding fairings 44 define a shielded region rearwardly thereof. The shielded region is the region in which the operator's and passenger's legs are disposed during operation of the watercraft 10. In particular, when seated on the watercraft 10, it is contemplated that the operator will place his or her feet in the foot rest areas 56 generally designated in FIGS. 4 and 5. Similarly, the passenger's feet typically will be placed just behind the foot rest areas 56. As a result, the passenger's feet and legs fall within the shielded region defined by the shielding fairings 44.

With the shielding fairings 44 positioned in the manner illustrated in FIGS. 1–5, and with the operator's feet positioned in the foot rest areas 56, the bottom half of the shielding fairings 44 partially cover the feet of the operator. As a result, the lower portions of the shielding fairings 44 may hinder the operator from embarking onto and disembarking from the watercraft 10. In particular, the lower portions of the shielding fairings 44 present an obstacle to placement of the operator's feet in the foot rest areas 56. The indented portions 48 are provided in the shielding fairings 44 to minimize this problem and facilitate embarkation and disembarkation.

In the typical case, when the operator wishes to board the watercraft 10, the operator will try to position his or her feet in the foot rest areas 56. Since the foot rest areas 56 are at least partially occluded by the bottom portions of the shielding fairings, the shielding fairings 44 may hinder the operator's ability to place his or her feet in the foot rest areas 56. The indented portions 48 provide a solution to this difficulty. In particular, the indented portions 48 provide a location through which the operator may pass a portion of his or her feet so that the foot rest areas 56 are more easily accessible.

Figure 5:
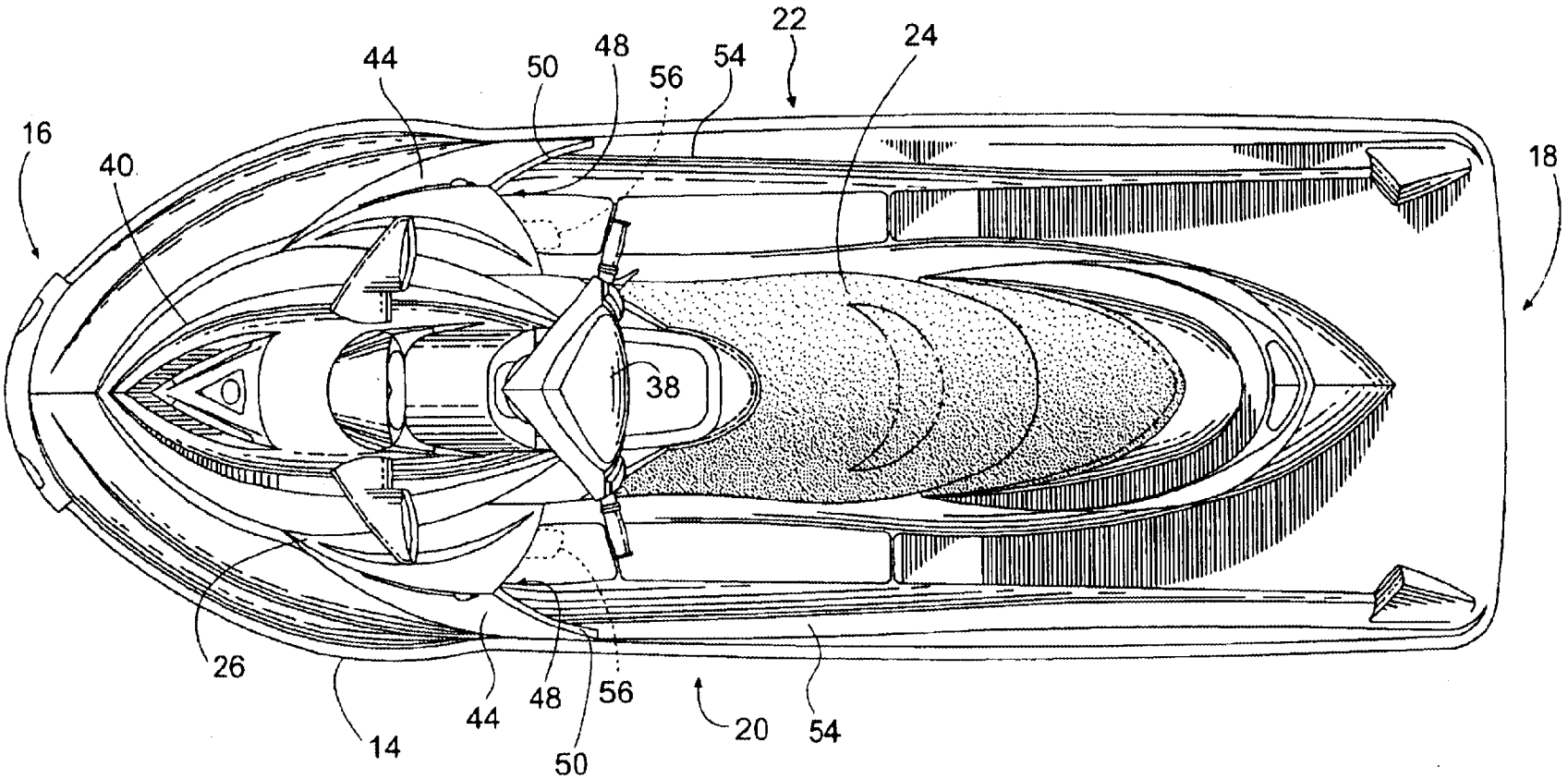
FIG. 5 is a top view of the watercraft shown in FIG. 1.

FIG. 5 is particularly illustrative of the way in which the indented portions 48 facilitate placement of the operator's feet in the foot rest areas 56. In particular, as the operator embarks on the watercraft 10, to avoid impact with the shielding fairings 44, the operator must lift his or her feet above the bottom portions of the shielding fairings 44 and move his or her feet laterally inward, before planting them in the foot rest areas 56. To disembark from the watercraft 1, the operator simply lifts his or her feet from the foot rest areas 56 to a height sufficient for his or her toes to pass through the indented portions 48, thereby clearing the shielding fairings 44.

While the embodiment of the present invention illustrated in FIGS. 1–5 shows a watercraft 10 with shielding fairings 44 having a lower portion that slopes downwardly and rearwardly, it is contemplated that the shielding fairings may take any shape and size without deviating from the scope of the present invention. For example, it is contemplated that the shielding fairings 44 may be configured so that they do not slope at all (i.e., the lower portion of shielding fairings 44 may extend perpendicularly from the deck 14). As would be appreciated by those skilled in the art, the lower portion of shielding fairings 44 alternatively may be sloped forwardly and/or rearwardly. In addition, it is contemplated that the shielding fairings 44 may be constructed so that they do not include the indented portions 48.

Figure 3:
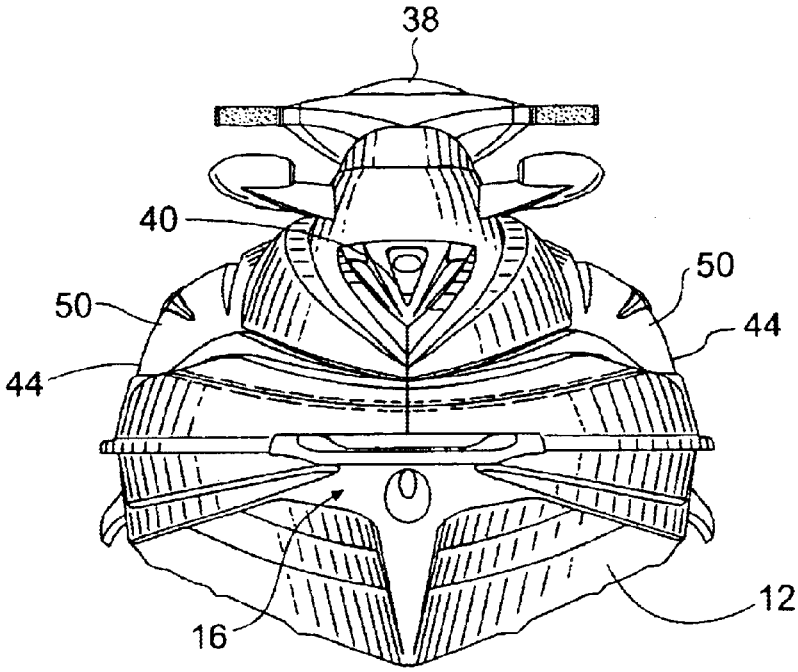
FIG. 3 is a front view of the watercraft shown in FIG. 1.

As illustrated in FIGS. 3 and 4, the shielding fairings 44 have a rounded profile when viewed from the front or rear of the watercraft 10. This maximizes the shielded region rearwardly of the shielding fairings 44. Such a shape, however, is not required to practice the present invention. As would be appreciated by those skilled in the art, the shielding fairings 44 could have a straight, curved, square, polygonal, or other profile when viewed from the front or rear.

As discussed in greater detail below in connection with FIGS. 6–10, the embodiment of the shielding fairings 44 illustrated in the drawings comprise two parts. The first is the body 50. The second is the cushion 52. The body 50 preferably is made of a thermoplastic material. The cushion 52 preferably is made of a polyurethane foam. While these two materials are contemplated for construction of the present invention, the present invention is not limited thereby. To the contrary, those skilled in the art would recognize that there are a plethora of alternative materials that may be used. In particular, the body 50 preferably should be made of a rigid plastic material that can be easily molded into the appropriate shape. While rigid, it is preferred that the body 50 offer some degree of flexibility so that the body 50 may easily withstand impacts from the operator's foot, for example, without becoming permanently deformed. As for the cushion 52, any other type of cushion material (such as another type of foam) may be used. It is preferred that the cushion provide a sufficiently resilient material to lessen the magnitude of any impact therewith, for example, with the operator's foot, shin, knee, or leg.

Figure 6:
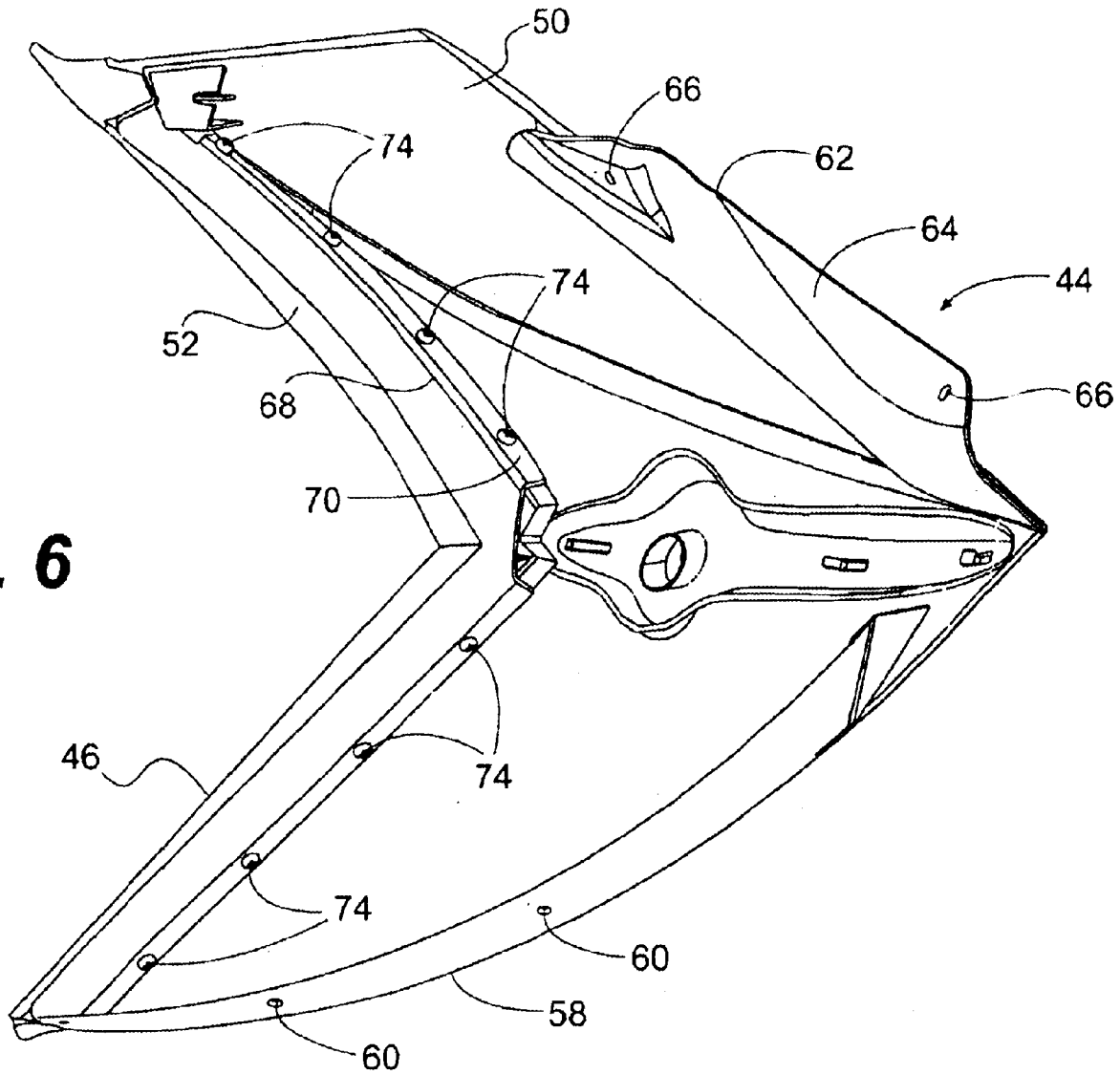
FIG. 6 is an interior view of the shielding fairing for the watercraft depicted in FIGS. 1–5.

FIG. 6 illustrates the interior side of one of the shielding fairings 44. The body 50 and the cushion 52 are clearly delineated. The bottom edge 58 of the shielding fairing 44 is provided with a plurality of holes 60 through which a fasteners (for example fasteners 84, illustrated in FIG. 10, and discussed in greater detail below) are disposed to connect the shielding fairing 44 to the gunwale 54. While only two holes 60 are visible in FIG. 6, those skilled in the art will readily appreciate that the shielding fairing 44 of the present invention may include any number of holes 60 greater than one to permit attachment of the shielding fairing 44 to the associated gunwale 54.

As shown in FIG. 6, the top edge 62 of the shielding fairing 44 is provided with an attachment flange 64. The attachment flange 64 includes two holes 66 that facilitate attachment of the shielding fairing 44 to the deck 14 adjacent to the cover 40. While only two holes 66 are illustrated, those skilled in the art will readily appreciate that the attachment flange 64 may include any number of holes 66 greater than one so that the shielding fairing 44 may be secured to the deck 14 at its top edge 62. Moreover, those skilled in the art also would readily appreciate that the shielding fairing 44 need not include an attachment flange 64 along its top edge 62. The holes 66 could just as easily be provided through a portion of the shielding fairing 44 without departing from the scope of the present invention.

Figure 8:
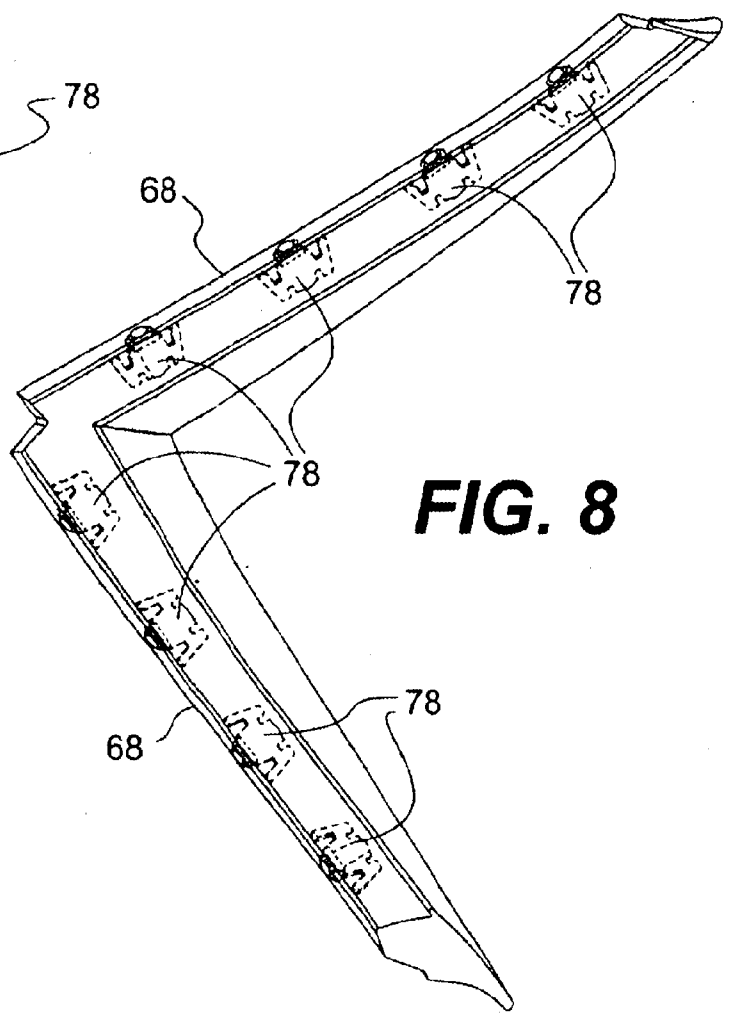
FIG. 8 is an interior side view of the cushion portion of the shielding fairing shown in FIG. 7.
Figure 7:
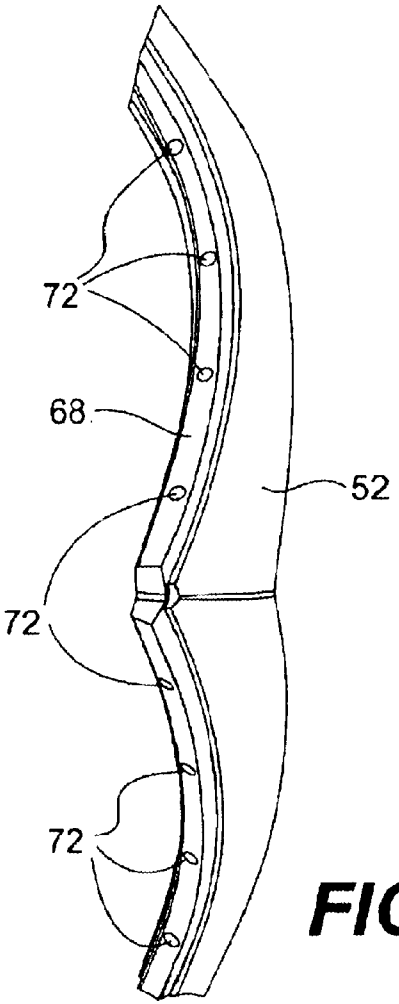
FIG. 7 is a front view of the cushion portion of the shielding fairing illustrated in FIG. 6.

The cushion 52 is depicted in greater detail in FIGS. 7 and 8. The forward edge 68 of the cushion 52 is designed to matingly engage the rearward edge 70 of the body 50 of the shielding fairing 44. Both the forward edge 68 of the cushion 52 and the rearward edge 70 of the body are provided with eight holes 72 that are positioned to align with one another when the cushion 52 and the body 50 are aligned with one another. As illustrated in FIG. 6, fasteners, such as screws 74, pass through the holes 72 to connect the cushion 52 and the body 50 together. As would be appreciated by those skilled in the art, eight holes are not required to practice the present invention. Any number of holes 72 greater than one is all that is needed to connect the body 50 and the cushion 52 together.

While the screws 74 may threadedly engage the forward edge 68 of the cushion 52 directly, it is contemplated, as illustrated in FIG. 8, that the screws 74 will engage bolts 78 positioned behind the forward edge 68 of the cushion 52. As indicated, the bolts 78 may be embedded within the cushion 52. It is believed that a fastener attachment between the body 50 and the cushion 52 greatly enhances the strength of the connection therebetween.

Figure 9:
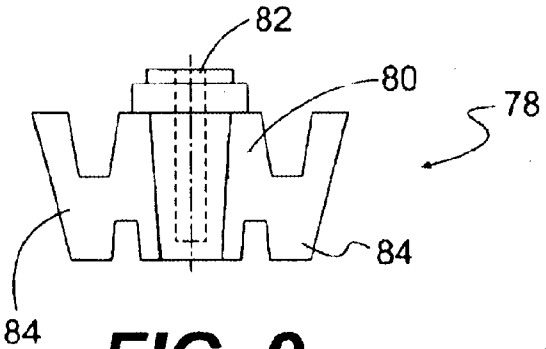
FIG. 9 is an enlarged side view of a fastener receiving element permitting removable attachment of the cushion to the body of the shielding fairing.

One of the bolts 78 is illustrated in FIG. 9 in greater detail. The bolt 78 includes a body 80 with a central bore 82. The threaded end of the screw 74 engages the bore 82 so that the cushion 52 may be secured to the body 50. So that the bolts 78 do not rotate when the screws 74 are fastened therein, wings 84 are provided on either side thereof to engage the material of the cushion 52. As would be appreciated by those skilled in the art, the particular construction for the bolts 78 is not required to practice the present invention. To the contrary, any other suitable bolt may be substituted therefor without departing from the scope of the present invention.

As FIGS. 7–9 suggest, it is contemplated as part of the invention that the cushion 52 may be removable from the body 50 so that the cushion 52 may be easily replaced. In an alternate embodiment, the cushion 52 may be affixed directly to the body via a suitable adhesive. In such a case, no holes 72 (or screws 74) would be needed to hold the cushion 52 onto the body 50.

It should be noted that, while the illustrated embodiment has a two piece construction, it is contemplated that the shielding fairing 44 could be comprised of any number of individual components connected together without deviating from the scope of the present invention. For example, the body 50 of the shielding fairing may be made of upper and lower sections that connect together along a horizontal seam. Similarly, the body 50 and the cushion 52 may each be made up of several individual components without deviating from the scope of the present invention.

Figure 10:
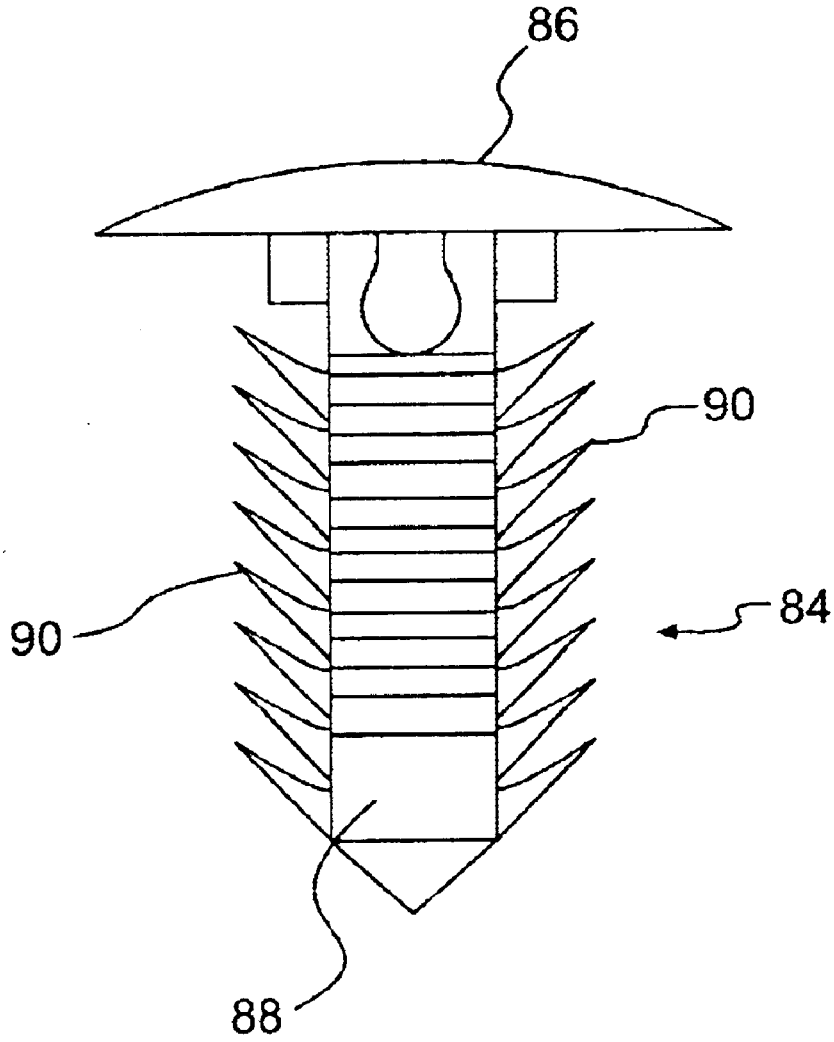
FIG. 10 is a side view of a fastener contemplated for connecting the shielding fairing to the deck of the watercraft illustrated in FIGS. 1–5.

FIG. 10 illustrates one example of the type of fastener 84 contemplated to connect the body 50 to the gunwale 54 and the portion of the deck 14 adjacent to the hood 40. To connect the body 50 to the gunwale 54, the shielding fairing 44 is positioned on the gunwale 54 so that the holes 60 align with holes in the gunwale 54. Fasteners 84 are then press-fitted into the holes. Similarly, to connect the body 50 to the deck along its top edge 62, the fasteners 84 are press-fitted through the holes 66 into corresponding holes in the deck 14 adjacent to the hood 40.

As shown in FIG. 10, the fastener 84 includes a head 86, a body 88, and at least one flexible extension 90 extending from the body 88. Since the extensions 90 are flexible, they are designed to compress against the body 88 as the body 88 is pressed into one of the holes 60, 66. After the extension 90 passes completely through the deck 14, the extension 90 flexes outwardly, away from the body 88. Thereby, the extensions 90 engage the interior surface of the deck 14 and hold the body 50 of the shielding fairing 44 on the deck 14. While the fastener 84 is preferred for use with the shielding fairing 44, those skilled in the art would readily appreciate that any other type of fastener (such as a nut and bolt) could be used instead, without departing from the scope of the present invention. In addition, a reinforcing strip may be included at the connection point between the deck 14 and the shielding fairings 44 to increase the strength of the connection between the two components of the watercraft 10.

It is also contemplated that the shielding fairings 44 may be affixed to the deck 14 via a fastener such as a glue, adhesive, or an epoxy. In one further alternative embodiment, the shielding fairings 44 may be integrally molded as a part of the deck 14, as would be appreciated by those skilled in the art.

Returning to FIG. 5, it is noted that the preferred embodiment places the outermost portion of the bottom of the shielding fairings 44 adjacent to the outer edge of the gunwales 54. This construction is preferred because it maximizes the foot rest areas 56 beneath the shielding fairings 44. It also maximizes the size of shielded regions behind the shielding fairings 44. As would be appreciated by those skilled in the art, however, the shielding fairings 44 need not be attached to the gunwales 54 or to a portion of the deck 14 adjacent to the hood 40. Instead, they may be attached at any location on the deck 14 without departing from the scope of the present invention.

In addition, while the present invention is contemplated for use on a personal watercraft 10, it is contemplated that the present invention could be adapted readily for use on other types of watercraft or vehicles (e.g., snowmobiles, motorcycles, ATVs, or the like) where it is desired to minimize the effect of environmental conditions on the operator and any passengers.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed:

1. A watercraft, comprising:

a hull;

a deck mounted on the hull;

a hood movably connected to a forward portion of the deck;

an engine positioned within the hull;

a seat mounted atop the deck for accommodating at least one rider, when seated; and at least one shielding fairing on the deck, wherein the shielding fairing extends laterally outwardly from the deck, wherein at least a portion of the shielding fairing is disposed forwardly of the seat, wherein the shielding fairing attaches to the deck at a position adjacent to the hood and extends to a position adjacent to a peripheral edge of the watercraft, and wherein the shielding fairing attaches to a gunwale laterally positioned on one side of the deck.

2. The watercraft of claim 1, wherein:

the seat is straddled by the at least one rider.

3. The watercraft of claim 1, wherein:

the at least one shielding fairing comprises two shielding fairings, disposed on opposite sides of the watercraft.

4. The watercraft of claim 3, wherein:

the shielding fairings each comprise more than one component assembled together.

5. The watercraft of claim 3, wherein:

the shielding fairings are manufactured as separate components that are attached to the deck.

6. The watercraft of claim 3, wherein:

the shielding fairings each comprise single, integral components.

7. The watercraft of claim 4, wherein the components comprise:

a body portion with a rear edge; and a cushion portion disposed on the rear edge thereof.

8. The watercraft of claim 7, wherein:

the body portion defines at least one hole through the rear edge thereof, the cushion portion includes at least one hole therein being in register with the hole in the body portion when the cushion portion and the body portion are aligned adjacent to one another, and a fastener is disposed in the holes in the body portion and the cushion portion to hold the cushion portion onto the body portion.

9. The watercraft of claim 7, wherein:

the body portion comprises a thermoplastic material; and the cushion portion comprises polyurethane foam.

10. The watercraft of claim 1, wherein:

the shielding fairing attaches to the gunwale and the deck via at least one fastener.

11. The watercraft of claim 10, wherein the fastener comprises:

a head;

a body extending from the head; and a plurality of flexible extensions on the body, the extensions capable of collapsing against the body when exposed to a compressive force.

12. The watercraft of claim 1, wherein:

the shielding fairing has a curved outer surface that bulges laterally outwardly from the deck.

13. The watercraft of claim 12, wherein:

the deck includes a foot rest area thereon; and the shielding fairing at least partially covers the foot rest area.

14. The watercraft of claim 12, wherein:

the shielding fairing defines a shielded region therebehind.

15. The watercraft of claim 1, wherein:

the hull defines a bow, and the shielding fairing is substantially V-shaped with its vertex pointing toward the bow of the watercraft.

16. The watercraft of claim 15, wherein:

the shielding fairing's end opposite to the vertex includes an indented portion facilitating embarkation onto and disembarkation from the watercraft.

17. A shielding fairing for a watercraft, comprising:

a body portion with a rear end; and a cushion portion disposed on the body portion at the rear end, wherein the shielding fairing is constructed and arranged to be disposable on the watercraft at a position forward of a seat thereon.

wherein the body portion defines at least one hole through the rear end thereof, wherein the cushion portion includes at least one hole therein being in register with the hole in the body portion when the cushion portion and the body portion are aligned, and wherein a fastener is disposed in the holes in the body portion and the cushion portion to hold the cushion portion onto the body portion.

18. The shielding fairing of claim 17, wherein:

the body portion comprises a thermoplastic material; and the cushion portion comprises polyurethane foam.

19. A shielding fairing for a watercraft, comprising:

a body portion with a rear end; and a cushion portion disposed on the body portion at the rear end, wherein the shielding fairing is constructed and arranged to be disposable on a watercraft at a position forward of a seat thereon.

wherein the body portion and the cushion portion are integrally molded together.

20. The shielding fairing of claim 19, wherein:

the body portion comprises a thermoplastic material; and the cushion portion comprises polyurethane foam.

21. A shielding fairing for a watercraft having a deck and at least one gunwale, comprising:

a body;

a first side constructed and arranged to attach to the deck;

a second side constructed and arranged to attach to the at least one gunwale; and a rear end, wherein the body is constructed and arranged to be removable from the deck and gunwale.

22. The shielding fairing of claim 21, wherein the body is substantially V-shaped.

23. The shielding fairing of claim 21, wherein the first and second sides form a vertex on the body constructed and arranged to face a bow of the watercraft.

24. The shielding fairing of claim 21, wherein the first and second sides define a plurality of apertures therethrough permitting placement of a plurality of fasteners therethrough to attach the body to the deck and the at least one gunwale.

25. The shielding fairing of claim 21, wherein the body comprises:

a rear edge; and a cushion disposed on the rear edge thereof.

26. The shielding fairing of claim 21, wherein the rear end includes an indented portion facilitating embarkation onto and disembarkation from the watercraft.

27. The shielding fairing of claim 21, wherein the body has a curved outer surface that bulges laterally outwardly.

28. The shielding fairing of claim 21, wherein the body is constructed and arranged to at least partially cover a foot rest area on the watercraft.

29. The shielding fairing of claim 21, wherein the body is constructed and arranged to define a shielded region therebehind when installed on the watercraft.

* * * * *